United States Patent [19]

Sullivan et al.

[11] 4,227,381

[45] Oct. 14, 1980

[54] WIND TUNNEL FREEZER

[75] Inventors: John J. Sullivan, Poynette; Eugene D. Prine, Madison, both of Wis.

[73] Assignee: W. R. Grace & Co., New York, N.Y.

[21] Appl. No.: 20,026

[22] Filed: Mar. 13, 1979

[51] Int. Cl.[3] ..... F25B 41/04

[52] U.S. Cl. ..... 62/223; 62/381

[58] Field of Search ..... 62/63, 266, 374, 375, 62/380, 381, 223; 432/115; 98/115 R

[56] References Cited

U.S. PATENT DOCUMENTS

| | | | |
|---|---|---|---|
| 2,327,041 | 8/1943 | Hill et al. | 62/170 |
| 2,831,329 | 4/1958 | Morrison | 62/173 |
| 3,024,117 | 3/1962 | Barlow | 62/63 |
| 3,238,736 | 3/1966 | MacIntosh | 62/63 |
| 3,304,732 | 2/1967 | Rubin | 62/63 |
| 3,461,680 | 8/1969 | Rische | 62/62 |
| 3,700,220 | 10/1972 | Talago | 432/115 |
| 3,714,793 | 2/1973 | Eigenbrod | 62/63 |
| 3,963,416 | 6/1976 | Mach | 98/115 R |
| 4,033,142 | 7/1977 | Schoesch et al. | 62/381 |
| 4,072,026 | 2/1978 | Oberpriller et al. | 62/63 |

OTHER PUBLICATIONS

*Linde BF-4 Biological Freezing System,* Union Carbide Cryogenic Products.

*Primary Examiner*—Ronald C. Capossela
*Attorney, Agent, or Firm*—Edward J. Cabic

[57] ABSTRACT

A batch freezing apparatus has a fan or blower to continuously circulate air through the freezing chamber and back again through a recycle conduit. A cold gas such as from a liquid nitrogen supply tank is added to the recirculating air to lower the temperature in the system in a controlled manner to provide rapid freezing. The freezing chamber is capable of rotation so the material being frozen in cylinderical containers can be rotated against and freeze upon the inner surface of the container during the freezing process. The apparatus is especially suitable for freezing bull semen.

14 Claims, 6 Drawing Figures

WIND TUNNEL FREEZER

BACKGROUND OF THE INVENTION

1. Field of the Invention

The present invention relates to a batch cryogenic freezing apparatus utilizing a cold gas mixture which continually circulates through the freezing chamber. Additional cold gas is added in a regulated amount to the mixture to control the freezing temperature and to control the rate of freezing.

2. Description of the Prior Art

One prior method of freezing a batch amount of material to a low temperature involves placing the material in containers which are then suspended a short distance above the level of liquid nitrogen in a liquid nitrogen storage container. Due to the cold equilibrium temperature existing above the liquid nitrogen, the materials will slowly lower in temperature until frozen and further subcooling has taken place. A disadvantage of this process, however, is that it takes a considerable amount of time for the materials to be frozen and there is a lower survival rate of product.

Another technique to freeze materials to subfreezing temperatures is to place the materials in containers and to then submerge the containers directly into liquid nitrogen. The disadvantage of this technique relates to the inability for some biological materials which contain water to withstand the very rapid rate of freezing which takes place when the materials are immersed in the extremely cold liquid nitrogen.

3. Objects of the Invention

It is an object of this invention to be able to cool batch quantities of materials in a rapid manner to very low sub-freezing temperatures.

It is another object of this invention to be able to freeze batch quantities of materials under accurately controlled temperature conditions so as to control the rate of cooling.

It is a further object of the invention to have a batch freezing apparatus with a controlled amount of a cooling gas circulating through the freezing chamber. The temperature and freezing rate is regulated by the addition to the circulating gas of a controlled amount of a cold gas.

It is another object of the invention to have a batch freezing apparatus with a freezing chamber capable of rotation so the material being frozen in cylinderical containers is rotated against the inner surface of the wall of the container during the freezing process.

These and other objects of the invention will become apparent as the description of this invention proceeds.

SUMMARY OF THE INVENTION

In the batch low temperature freezing apparatus of this invention, the recirculating cooling gas permits careful control of the temperature in the freezing chamber while also controlling the rate of freezing. The device has a freezing chamber with a gas inlet means on one side of the chamber and a gas outlet means on the other side. A gas recirculating line connects the outlet means with the inlet means. A fan or blower is inserted in the recirculating line to continuously circulate air. In order to lower the temperature in the system, a cold gas is supplied into the recirculating line by a supply line from a cold gas source such as a liquid nitrogen supply tank. A valve on the end of this supply line can be controlled by a conventional pneumatic controller. This pneumatic controller will vary the valve opening in the cold gas supply line which in turn regulates the amount of cold gas being added to the system. In a preferred embodiment, the cold gas is nitrogen as obtained by the vaporization of liquid nitrogen and this gas supply line is inserted in the inlet side of the fan or blower. The cold nitrogen gas mixes with the circulating air to produce a cold gas mixture which feeds into the fan. It is then blown out of the outlet side of the fan into the gas inlet means which directs it into the freezing chamber to cool down the materials being held in the freezing chamber. A distributor structure can be placed in the gas inlet means to distribute the gas across the entire cross-sectional area of the larger freezing chamber as the gas enters from the smaller opening of the fan outlet.

By having a thermocouple or other type temperature measuring device in the system, the temperature of the circulating gas can be determined. If a still lower temperature is desired, then the valve can be opened further to permit more of the cold gases to enter the system and lower the temerature of the circulating gas mixture.

After the temperature in the system has been lowered to the desired point, the valve controller can close the valve shutting off the cold gas supply line and the fan can be turned off. The freezing chamber is opened and the frozen product is then removed. Since it is now frozen solid, it can be placed into liquid nitrogen to further lower the temperature.

The apparatus can be defrosted by turning on the fan. The air circulating through the device (without the presence of any additional cold gas) will heat the gas conduits by friction and remove any frost which may have formed on the apparatus during the freezing operation.

Another embodiment of the invention involves the rotation of the freezing chamber during the freezing process. In this embodiment flanges suitable for rotation are mounted on the end of the gas inlet means and the end of the gas outlet means. These flanges are arranged in rotational contact with the adjacent connecting sections of the two ends of the gas recirculating line. The freezing chamber is rotated by an electric motor which drives a chain drive arranged around a rotatable part of the freezing chamber assembly such as the gas inlet means. This embodiment is advantageous when the material is to be frozen in individual ampules. The ampules can be oriented in the freezing chamber longitudinally and parallel to the axis of the freezing chamber. The material is then permitted to freeze while the freezing chamber is rotating around its central axis. This rotation causes the liquid in the ampules to be constantly urged out towards the inner circumference of the ampules in a uniform manner so that a shell freezing result is obtained.

To facilitate loading the materials in and out of the freezing chamber, a box-like container can be employed having handles. This box container can be filled with a series of smaller containers with each of these smaller containers in turn containing racks or other types of holding devices to hold small straws or ampules containing the individual material to be ultimately frozen.

This freezing device is especially useful for freezing biological type materials where it is desired to control the rate of freezing. Especially good results have been used in the process of freezing bull semen with this device.

DESCRIPTION OF THE PREFERRED EMBODIMENTS

Figure 1:
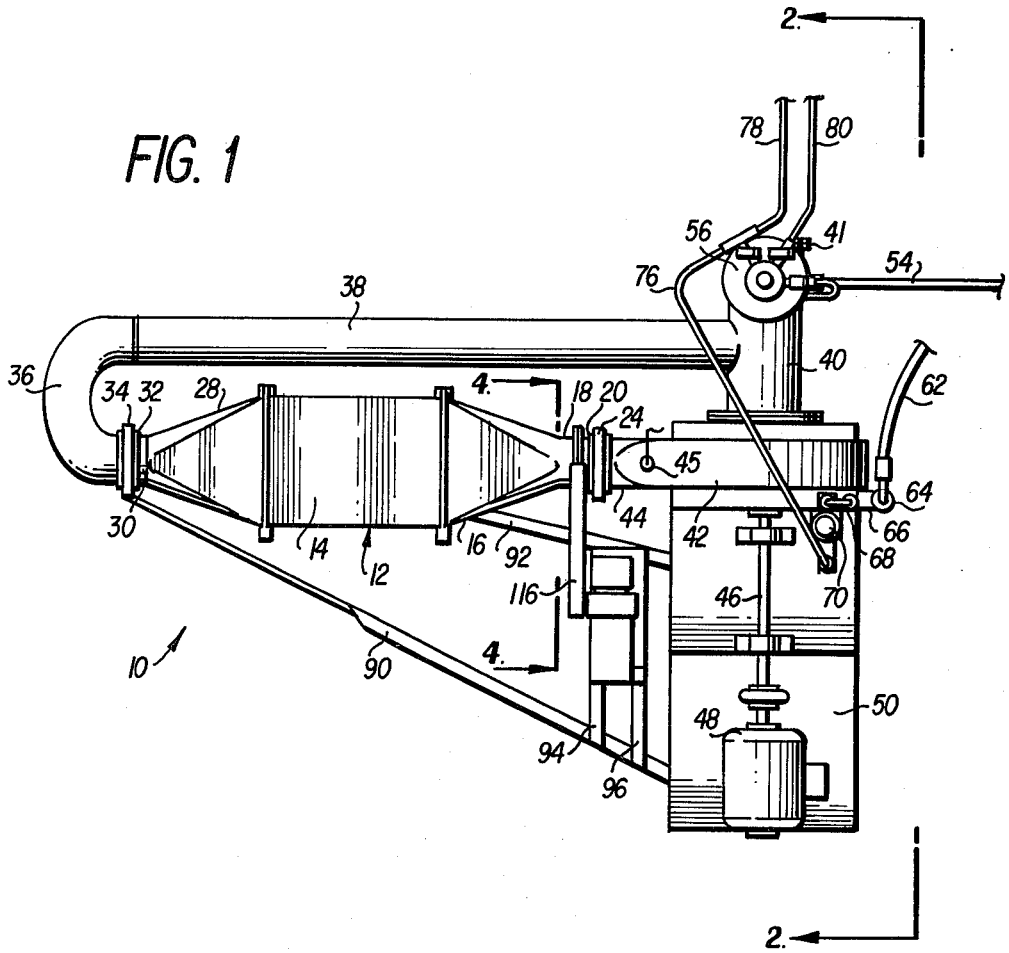
FIG. 1 is a top view of the freezing apparatus.

The overall freezing apparatus 10 is illustrated in the top view of FIG. 1. It consists of a freezing chamber 12 having a generally rectangular configuration with a hinged top 14 which opens upwardly to permit entry of the articles to be frozen. On the right side of the chamber as shown in FIG. 1 is a tapered gas inlet means 16 which tapers down from the rectangular configuration of the chamber 12 to a circular inlet pipe configuration 18. This inlet pipe unit terminates in a flange portion 20 which is supported by and capable of rotation against a mounting flange 24. The opposite side of the freezing chamber 12 has a gas outlet means consisting of a tapered unit 28 to again reduce the rectangular configuration down to the circular configuration of outlet pipe 30 where the terminal end flange 32 also is supported by and capable of rotation against a mounting flange 34. The gas recycle conduit consists of this flange mounting means 34, a connected U-shaped pipe 36 which is in turn connected to a return line 38 which terminates into a mixing chamber 40. The circular chamber 40 has one end closed off by a spring loaded damper plate 41 and the other end connected to the inlet of a centrifugal fan 42. The fan can be a conventional pressure blower such as the NYB Pressure Blower Type P made by the New York Blower Company in LaPorte, Indiana. Conduit 44 connects the outlet on top of the centrifugal fan with the gas inlet means mounting flange 24 so the gas leaving the fan will be delivered into the pipe 18 of the gas inlet means. The fan 42 is drive by shaft 46 which in turn is driven by an electric motor 48 such as 7½ H.P. motor mounted on the elevated platform 50.

Cooling gas is supplied to the apparatus from a pressurized liquefied gas supply vessel (not shown) via line 54. Low-boiling liquefied gases which are suitable for use as refrigerants in the present invention are those which have a boiling point at atmospheric pressure below about −20° F. Examples of such liquefied gases are liquid air, liquid argon, liquid carbon dioxide, liquid helium, and liquid nitrogen. Liquid nitrogen is particularly suitable because of its inertness and relative ease of separation from air, and is preferred. While the subsequent discussion refers specifically to nitrogen, it is to be understood that all of the aforementioned gases are suitable along with mixtures thereof.

Figure 2:
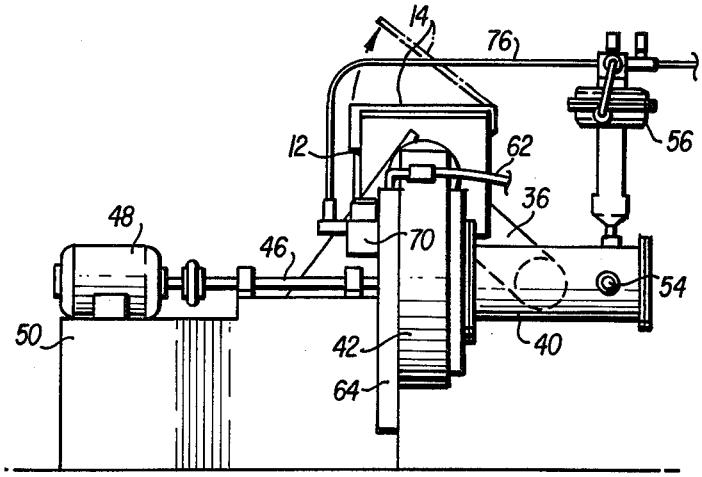
FIG. 2 is an end view taken along line 2—2 of FIG. 1.

The supply line 54 enters the device in chamber 40 with a pneumatic valve 56 controlling the amount of liquid nitrogen which enters into the device. This valve 56 is a conventional type such as the Model I Inch built by Masoneilion Internation Inc. An air compressor (not shown) provides supply air for the valve via line 62. The air first passes into a water trap 64, which is a long tubular container as shown in FIG. 2. From the upper portion of the trap 64 the air exits through an opening 66 and passes through line 68 to a pressure regulator 70. By controlling the setting on the pressure regulator, the desired air pressure is obtained. This air under the desired pressure then passes through line 76 to the valve. Air pressure control lines 78 and 80 from the controller panel (not shown) operate the valve 56 so as to regulate the amount of liquid nitrogen entering the device from supply line 54. Other types of valve controllers could be used, such as programmable controller which sends electrical signals to a transducer, such as a Honeywell Electro-Pneumatic transducer, at the valve unit where the electrical signals are converted to a pneumatic form to operate the valve. An example of this type of device is the Honeywell Digital Control Programmer DCP-7700 built by the Honeywell Company. A platinum resistance thermometer bulb located at conduit 44 signals to the controller the circulating air temperature.

Various supporting structures can be used to arrange and stabilize the apparatus components. For example, frame support member 90 and 92 on the floor can be connected to the fan motor support box 50 and have upwardly extending legs 93 (not shown) to support the flange mounting means 34. The legs 93 are replaceable and can be used in two different lengths. In the embodiment where straws are used to store the material, the freezing chamber can be horizontal. In this case the legs 93 can be of a regular length to raise mounting flange 34 to the appropriate height so the freezing chamber is horizontal. In the embodiment where ampules are used to store the material, it is preferred to have all of the liquid down in the barrel portion of the ampule and with no liquid in the upper cap portion. This can be accomplished by loading the chamber with ampules having their cap ends pointing toward the gas inlet means and by slightly lowering the left end of the freezing chamber as seen in FIG. 1. This is done by using shorter replacement legs 93 to lower the mounting flange 34.

Figure 4:
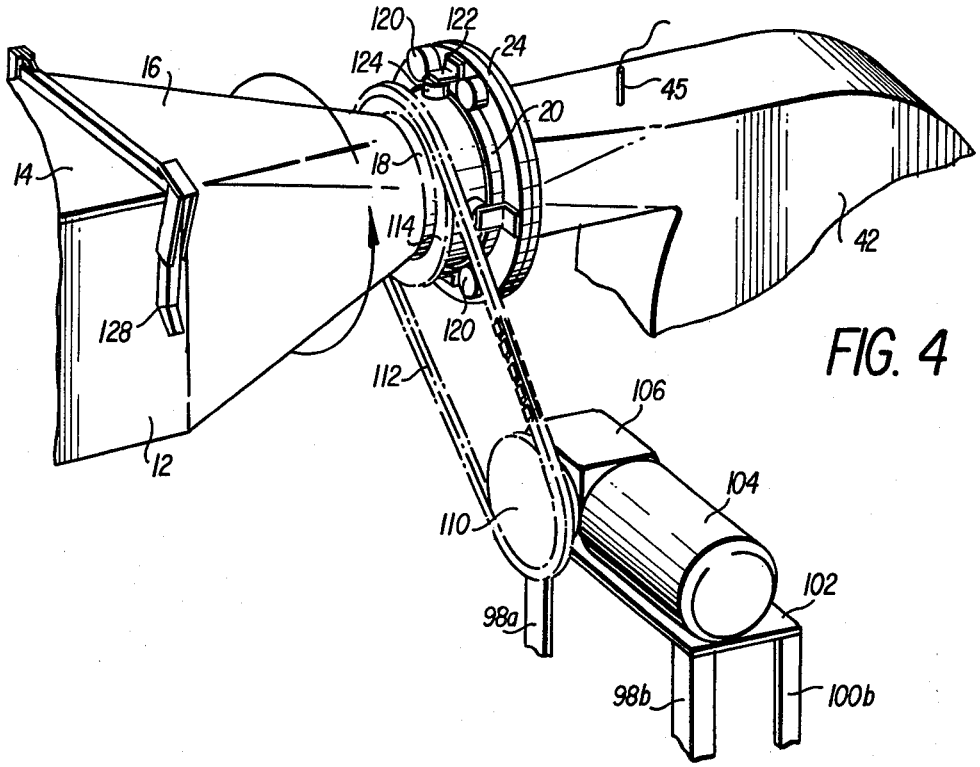
FIG. 4 is a detailed view of the drive mechanism to rotate the entire freezing chamber.

Additional support members 94 and 96 across the members 90 and 92 can be provided from which support legs 98*a*, 98*b*, 100*a* (not shown) and 100*b* extend as illustrated in FIG. 4. These legs in turn support a platform 102 on which is located a motor 104 to provide an auxiliary drive to rotate the chamber 12 in an optional embodiment. As shown in the top view of FIG. 1, the auxilliary drive utilizes a chain drive, and a chain guard 116 can be placed over the chain. This embodiment is further shown and described in FIG. 4.

FIG. 2 is a back-end view taken along line 2—2 of FIG. 1. This back view shows the relationship of the elevated fan motor 48 which drives the centrifugal fan 42. The mixing chamber 40 is shown with the cooling gas supply line 54 entering and its relationship with the valve 56. The rectangular configuration of the freezing chamber 12 is illustrated, as well as the top 14 of the chamber shown in the open position in phantom.

Figure 3:
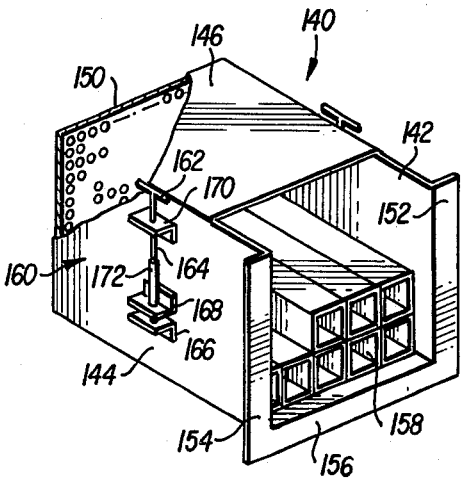
FIG. 3 is a perspective view of a container for holding items which are to be inserted in the freezing chamber.

FIG. 3 illustrates one form of a product holding container 140 that can be used to easily and quickly insert the products to be frozen into the freezing chamber. It has a rectangular configuration with side walls 142 and 144 and with top 146 and bottom 148 (not shown). The back wall 150 has many perforations throughout to permit the cooling gas to easily pass through. The front end of the container is open to permit loading of the articles to be frozen. The size of the container is made smaller than the opening in the freezer chamber 12 opposite the gas inlet means so handles can be arranged on either side of the container to lower and raise the container in and out of the freezer chamber. To direct the incoming gas to flow only through the interior of the container, flanges 152 and 154 are positioned on the front edges of walls 142 and 144 respectively, as well as a flange 156 on the bottom wall 148. These flanges prevent or reduce the amount of gas flowing from the gas inlet means into the freezer chamber from flowing needlessly along the outside of the container. Thus most of the gas passes essentially through the interior of the container where the products to be frozen may be provided in a plurality of storage containers such as units 158 shown in the FIG. 3. In the case of freezing bull semen, the semen can be sealed in either glass or plastic ampules with eight ampules stored in a rack such as the one disclosed in U.S. Pat. No. 3,130,836. These racks are then loaded into the units 158 which in turn are placed into the container 140. An alternative way to freeze bull semen is to place the semen in straws which are placed in a rack holder such as disclosed in U.S. Pat. No. 3,743,104. Again these racks can then be loaded into the units 158 which in turn are placed into the the units 158 which in turn are placed into the container 140.

On either side of the container 140 is a retractable handle mechanism to permit the raising and lowering of the container into the freezing chamber. For example, a handle assembly 160, illustrated in FIG. 3, can be provided having a top handle element 162 and a downward extending member 164 with an L-shaped plate 156 attached at its bottom end. The downward extending member of the handle passes through bottom guide 168 and an upper guide 170 attached to the side of the container. A spring 172 serves to urge the handle element 162 in an upward position so that upon opening the top 14 of the freezing chamber the handles will move upwardly for easy grasping.

One of the optical features of the present device is the ability to rotate the freezing chamber 12 during the freezing process. This embodiment is especially desirable when semen is being frozen in ampules. In this freezing embodiment it is advantageous to have the material uniformly deposited about the interior circumference of the ampule as the freezing takes place. This result is obtained by loading the ampules into the ampule rack discussed above, placing the racks into the containers 158 which are inserted in the container 140 shown in FIG. 3. The loaded container 140 is then placed in the freezing chamber 12 and then the entire freezing chamber 12 can be rotated.

To perform this function, a motor 104 on table 102 shown in FIG. 4, supported by legs 98*a*, 98*b*, 100*a* and 100*b*, is connected to a gear mechanism 106 which converts the rotational motion of the motor to a right angle drive to gear 110 attached to the gear mechanism 106. A chain 112 connects the gear 110 to a similar gear 114 that is integral with the pipe 18 on the gas inlet side of the freezing chamber. As shown in FIG. 1, this chain can be protected with a chain guard 116.

To permit rotation of the freezing chamber 12 about its two ends, the entire freezing chamber assembly, including the gas inlet and gas outlet means, is mounted for rotation against the supporting flanges 24 and 34 as shown in FIG. 1. Each end has the same construction as shown in FIG. 4 for the inlet end engaging its supporting flange 24. On the side of the flange 24 facing the freezing chamber is a series of rollers 120 which contact the outer circumference of flange 20 that is on the terminal end of the gas inlet means. These rollers 120 guide and support the round flange 20 and permit it to rotate about its axis. To maintain this end flange 20 against the supporting flange 24, the same side of the supporting flange 24 also as a series of brackets 122 around the periphery of the supporting flange 24. These brackets have associated rollers 124 mounted thereon that extend inwardly and press against the backside of the round flange 20 to maintain the contact between the flange 20 and the supporting flange 124. With this same type of construction at the opposite end, the freezing chamber 12 and the associated tapered sections of the gas inlet and gas outlet are thus free to rotate when the motor 104 is started.

FIG. 4 also illustrates the lock mechanism 128 which can be used to lock the top 14 of the freezing chamber 12 in the closed position so that when the device is rotated the top will not fly open.

Figure 5:
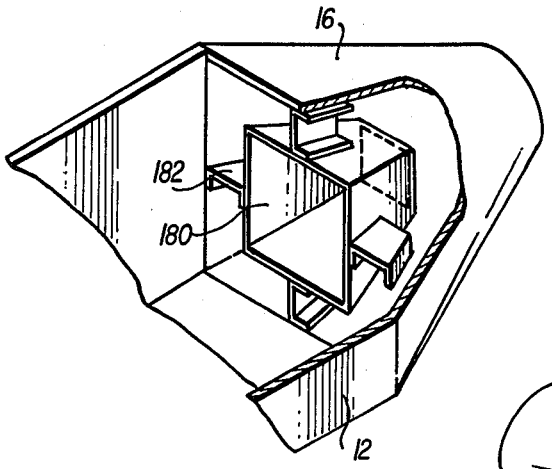
FIG. 5 is an internal perspective view of the freezing chamber showing the gas distributor in the gas inlet means.

FIG. 5 illustrates a preferred embodiment in which a gas distributor 180 is positioned in the inlet portion of the tapered gas inlet means 16. This gas distributor is made in a hollow four-sided construction having a generally trapezohedronal configuration. The gas distributor 180 is suspended in the middle portion of the gas inlet duct 16 by brackets 182 on each side of the gas distributor. The upstream end of the gas distributor has a smaller opening than the downstream end so, as the gas flows downstream to the freezing chamber from the fan, the gas is distributed throughout the entire cross-sectional area of the freezing chamber 12.

Figure 6:
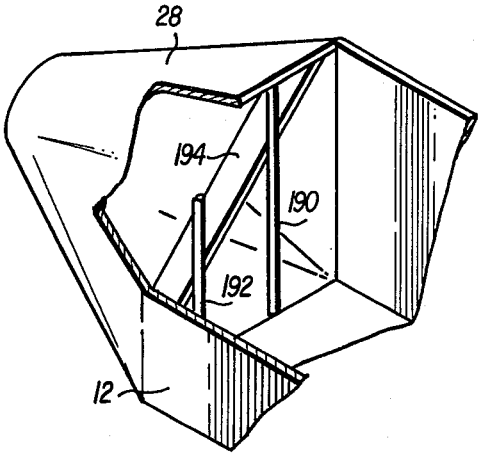
FIG. 6 is an internal perspective view of the freezing chamber showing the structural reinforcement in the gas outlet means.

FIG. 6 is a view looking into the freezing chamber 12 in the direction of the tapered gas outlet means 28 to show a possible reinforcing construction of the device in the form of vertical support rods 190 and 192 and a cross-beam 194 to add further structural rigidity to the freezing chamber.

The conduit means through which the cooling gas flows, including the gas inlet means, the freezing chamber and the gas outlet means, can be covered with insulation to keep the cooling gas cold and to retard the build-up of frost on the outside of the apparatus.

In the method of operation of the device, the top 14 of the freezing chamber 12 is opened. The container 140, shown in FIG. 3, is loaded with articles to be frozen such as by first loaded these articles in racks which are placed within the rectangular holder units 158 shown in FIG. 3. These holder units 158 are then placed in the container 140, and the container 140 is grasped by handles 162 and lowered down into the freezing chamber 12. The top of the freezer chamber 12 is closed, and the door lock 128 is secured. The fan 42 is turned on, and the controller 56 is initially set to allow a small amount of cooling gas such as from a liquid nitrogen supply force to enter the system. The liquid nitrogen, upon entering the mixing chamber 40, forms a gas which cools the air in the system which is being circulated through the freezing chamber. As lower temperatures are desired, a larger quantity of liquid nitrogen is permitted into the system by the valve controller 56. A thermocouple can be inserted in the system to measure the resulting gas temperature circulating through the device. Finally, after the gas temperature has been lowered to the desired point so the material in the freezing chamber is completely frozen, the controller can be turned off so that no more cooling gas enters the system. Fan 42 is then turned off and the top door 14 is opened to permit removal of the frozen product in the container 140. The product can then be either transferred to a freezing room or it can be immersed into a container of liquid nitrogen to further cool down the solidified product.

Once the container 140 has been removed from the system, the door 14 can be closed and the fan turned on again without any cooling gas present to circulate air through the system. The friction produced by the air flowing through the device will warm and remove any frost that may have formed on the apparatus.

In the embodiment where the articles being frozen are to be rotated during the freezing process, the motor 104 is turned on to drive the chain 112 which in turn causes the freezing chamber 12 and the associated gas inlet means 16 and gas outlet means 28 to rotate. Again, once the product has been frozen, the motor 104 can be turned off.

One of the advantages of the present apparatus is that the rate of cooling gas can be positively controlled. By use of the valve 56 regulating the amount of the cooling gas entering the system, one can control the rate at which the freezing takes place. A further advantage is that with the cooling air blowing rapidly past the ampules or straws, there is a much greater rate of heat transfer taking place than if these containers were just maintained in static air at the same temperature.

It is understood that the foregoing detailed description is given merely by way of illustration and that many variations may be made therein without departing from the spirit of this invention.

What is claimed is:

1. An apparatus for cryogenic batch freezing of a large volume of material comprising a freezing chamber with entry means to permit insertion of the material to be frozen in the chamber;

a gas inlet means on one side of the chamber;

a gas outlet means on the opposite side of the chamber;

gas recycle conduit means positioned outside the freezing chamber connecting the gas outlet means of the chamber with the gas inlet means of the chamber to thereby form a gas conduit system;

fan means positioned in the gas recycle conduit means outside the freezing chamber to circulate gas throughout the apparatus;

container means within said chamber adapted to hold said material to be frozen and being removable from said chamber to withdraw the frozen product, said container means having openings in the sides adjacent the gas inlet and gas outlet means to permit the circulating cold gas to pass through the container means so the gas is in direct contact with said material being frozen; and control means to add a variable amount of the cooling gas into the gas conduit system at any desired cooling rate whereby the fan means circulates the resulting cold gas mixture rapidly through the freezing chamber to control the temperature.

2. The apparatus of claim 1, wherein the gas inlet means is at one end of the freezing chamber and the gas outlet means is at the other end.

3. The apparatus according to claim 2, wherein the planes of the two ends of the freezing chamber are vertical and the direction of gas flow through the freezing chamber is horizontal.

4. The apparatus according to claim 2, further comprising adjustable supporting means to support the freezing chamber whereby the freezing chamber can be maintained horizontal or inclined with one end lowered.

5. The apparatus according to claim 1, wherein said means to add a controlled amount of the cooling gas into the gas recycle conduit means comprises a cooling gas inlet means in said gas recycle conduit means having a valve, and a valve controller means to control the operation of the valve.

6. The apparatus according to claim 5, wherein the cooling gas inlet means is positioned upstream of the fan means.

7. The apparatus according to claim 1, wherein the gas inlet means further comprises a gas distributor means to distribute the gas prior to entry into the freezing chamber.

8. The apparatus according to claim 1, further comprising means to rotate the freezing chamber.

9. The apparatus according to claim 8, wherein the gas inlet means and the gas outlet means are integral to the freezing chamber and rotate with the freezing chamber.

10. The apparatus according to claim 9, wherein the freezing chamber is rectangular in configuration and the gas inlet means and the gas outlet means are tapered from the rectangular configuration to a circular terminal and configuration.

11. The apparatus according to claim 10, wherein each terminal end of the gas inlet means and the gas outlet means has a flange in rotational contact with an adjacent stationary end flange of the gas recycle conduit means.

12. The apparatus according to claim 11, further comprising means to maintain each flange of the gas inlet means and the gas outlet means in rotational contact with the stationary end flange of the gas recycle conduit means.

13. The apparatus according to claim 1, further comprising insulation means surrounding the apparatus to keep the circulating gas cold and retard build-up of frost.

14. The apparatus according to claim 1, further comprising a temperature sensing means to measure the temperature of the cold gas mixture.

* * * * *